US006293854B1

(12) United States Patent
Kimura et al.

(10) Patent No.: US 6,293,854 B1
(45) Date of Patent: Sep. 25, 2001

(54) DRESSER FOR POLISHING CLOTH AND MANUFACTURING METHOD THEREFOR

(75) Inventors: Kenichi Kimura; Moriyasu Kanenari, both of Miyagi (JP)

(73) Assignee: Read Co., Ltd., Yokohama (JP)

( * ) Notice: Subject to any disclaimer, the term of this patent is extended or adjusted under 35 U.S.C. 154(b) by 0 days.

(21) Appl. No.: 09/612,959

(22) Filed: Jul. 10, 2000

(30) Foreign Application Priority Data

Dec. 20, 1999 (JP) ..... 11-361753

(51) Int. Cl.[7] ..... B24B 1/00
(52) U.S. Cl. ..... 451/56; 451/443; 451/548
(58) Field of Search ..... 51/295, 307; 451/539, 451/56, 28, 443, 444, 540, 541, 548, 550

(56) References Cited

U.S. PATENT DOCUMENTS 5,921,856 * 7/1999 Zimmer ..... 451/539
5,989,405 * 11/1999 Murata et al. ..... 205/110

FOREIGN PATENT DOCUMENTS 10-012579 1/1998 (JP) .

* cited by examiner

*Primary Examiner*—Derris H. Banks
(74) *Attorney, Agent, or Firm*—Oblon, Spivak, McClelland, Maier & Neustadt, P.C.

(57) ABSTRACT

The present invention provides a dresser for a chemical and mechanical polishing cloth wherein a bonding material for retaining diamond grit is not dissolved and contamination of chemical slurry caused by dissolving of metal or peeling-off of diamond grit is prevented from occurring. A sintered product constituting the dressing face 2*a* is obtained by mixing a bonding material 4 consisting of silicon and/or silicon alloy with diamond grit 3, and forming and sintering the mixture. A carbide film 5 generated by sintering silicon in the bonding material into diamond is formed on the surface of the diamond grit 3. Thereby, the diamond grit is firmly bonded with the bonding material, and the bonding material is not dissolved. As a result, the contamination of the chemical slurry or the peeling-off of the diamond grit is prevented.

11 Claims, 3 Drawing Sheets

DRESSER FOR POLISHING CLOTH AND MANUFACTURING METHOD THEREFOR

FIELD OF THE INVENTION

The present invention relates to a dresser for a polishing cloth used for removing clogging or foreign material in a step of Chemical and Mechanical Polishing (hereinafter referred to as CMP) and to a manufacturing method therefor.

DESCRIPTION OF RELATED ART

In steps of manufacturing highly integrated electronic circuits such as integrated circuits, CMP processing is generally used to remove surface defects such as protrusions, crystal lattice defects, scoring, or roughness on a conductive layer, a dielectric layer or an insulation layer formed on a substrate or wafer. In CMP processing, a wafer is pressed on an abrasive cloth made of polyurethane foam or the like by a predetermined load, adhered to a disk surface plate, and the wafer is polished by rotating both the wafer and the cloth with an abrasive fluid called a chemical slurry. A preparation in which abrasive particles such as iron oxide, barium carbonate, cerium oxide, or colloidal silica are suspended in an abrasive fluid such as potassium hydroxide, dilute hydrochloric acid, aqueous hydrogen peroxide, or iron nitrate, is used as the chemical slurry, and this produces a higher polishing rate and high selectivity for each layer.

CMP is performed many times in steps for stacking various kinds of electronic circuits. When the number of CMPs is increased, particles or polishing dust burrows into minute cracks, causing clogging, and this reduces the polishing rate. Accordingly, operations called dressing, by which the surface of the polishing cloth is replaced to restore the polishing speed, are required to be executed often or regularly. For this operation, an instrument called a dresser for a CMP polishing cloth is used.

Since diamond grit is an excellent dressing material, a dresser for CMP polishing cloth employing diamond grit is discussed. For example, a method of electrodepositing the diamond grit on stainless steel by nickel plating has been proposed. Also, in Japanese Unexamined Patent Application Publication No. 10-12579, a method of brazing the diamond grit on the stainless steel by a metallic-brazing material has been proposed.

However, the nickel plating material or the metallic-brazing material is dissolved by strongly acidic chemical slurry, and the slurry is contaminated and the diamond grit is peeled, potentially causing scoring on the surface of the wafer.

Therefore, a dresser for CMP abrasive cloth in which dissolution of metal or peeling-off of diamond grit might not occur in CMP is anticipated.

SUMMARY OF THE INVENTION

The present invention was made to solve the above problem. The technical challenge thereof is to provide a dresser for CMP polishing cloth and a manufacturing method therefor in which bonding material for holding the diamond grit will not be attacked by the strongly acid chemical slurry, causing contamination of the slurry by metallic dissolution or peeling off of the diamond grit CMP processing for the highly integrated electronic component such as an integrated circuit.

It is another challenge to provide the dresser for polishing and a manufacturing method therefor which is obtained by simple means and in which the bonding material will not be dissolved by the chemical slurry.

To solve the above challenges, the first dresser for the polishing cloth according to the present invention is characterized in that the dresser face comprises a sintered product obtained by mixing a bonding member comprising a silicon and/or silicon alloy with the diamond grit, and forming and sintering the mixture, the surface of the diamond grit being provided with a carbide film generated by sintering silicon in the bonding material into the diamond, whereby the diamond grit is firmly bonded with the bonding material.

The second dresser polishing cloth according to the present invention is characterized in that the dresser face comprises a sintered product obtained by mixing the bonding member comprising a silicon and/or silicon alloy with the diamond grit coated with a carbide film of a metal in group IV, V or VI of the periodic table, and forming and sintering the mixture, the diamond grit being firmly bonded to the carbide film in the sintered product.

In the dresser for a polishing cloth, the sintered product is adhered on the surface of a pedestal, the product is finished into specified size, and the diamond grit is exposed by planarizing and dressing on the dressing surface.

On the other hand, the manufacturing method of the first dresser for an abrasive cloth according to the present invention is characterized in that a carbide film is produced on the surface of the diamond grit by sintering the diamond into the silicon in the bonding member, by mixing the bonding material comprising the silicon or the silicon alloy with the diamond grit, the mixture being formed and sintered, and in that the sintered product for dressing, in which the diamond grit is firmly bonded with the bonding material, is obtained.

Furthermore, the manufacturing method for the second dresser for abrasive cloth according to the present invention is characterized in that silicon and/or silicon alloy is mixed with diamond grit coated with carbide film of metal in group IV, V, or VI in the periodic table, and forming and sintering the mixture, thereby yielding the sintered product for dressing in which said diamond is firmly bonded with the bonding member by the carbide film.

According to the dresser for abrasive cloth and the manufacturing method therefor, in CMP processing of highly integrated electronic circuit material such as integrated circuits, the bonding material comprising silicon and/or silicon alloy has excellent acid-resistance in acidic solutions such as nitric acid. As a result, polishing fluid is not contaminated, and this simplifies the wafer cleaning step after CMP.

Furthermore, according to the present invention, the dresser for abrasive cloth and the manufacturing method in which the bonding material will not be dissolved by the chemical slurry, is obtained by simple means.

DETAILED DESCRIPTION OF THE INVENTION

In the dresser for a CMP polishing cloth according to the present invention, the dressing face thereof comprises the sintered product obtained by mixing the bonding member comprising the silicon or the silicon alloy with the diamond grit coated with carbide film generated by the diamond grit or the above-described metal from the periodic table, and by forming and sintering the mixture. Specifically, the sintered product is adhered to the surface of a pedestal made of ceramic, plastic or the like, then the dressing face is subjected to planarizing and dressing processing to finish it into specified size as well as exposing the diamond grit.

If the sintered product is obtained by mixing the bonding material comprising silicon or silicon alloy with the diamond grit and forming and sintering the mixture, a carbide film is formed on the surface of the diamond grit by sintering of the silicon in the bonding material into the diamond. Thereby, the diamond grit is bonded firmly with the bonding material.

Figure 1:
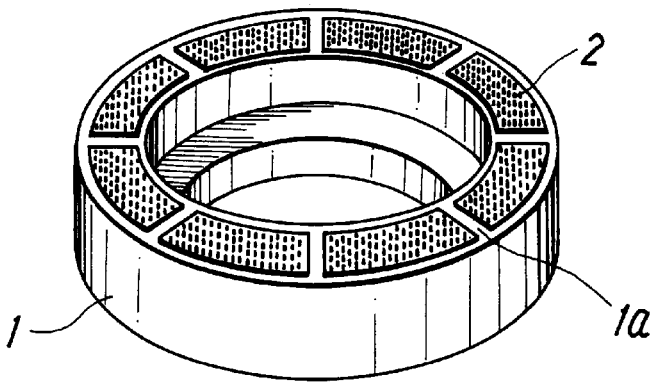
FIG. 1 is a perspective view showing an example of a dresser for a polishing cloth according to the present invention.
Figure 2:
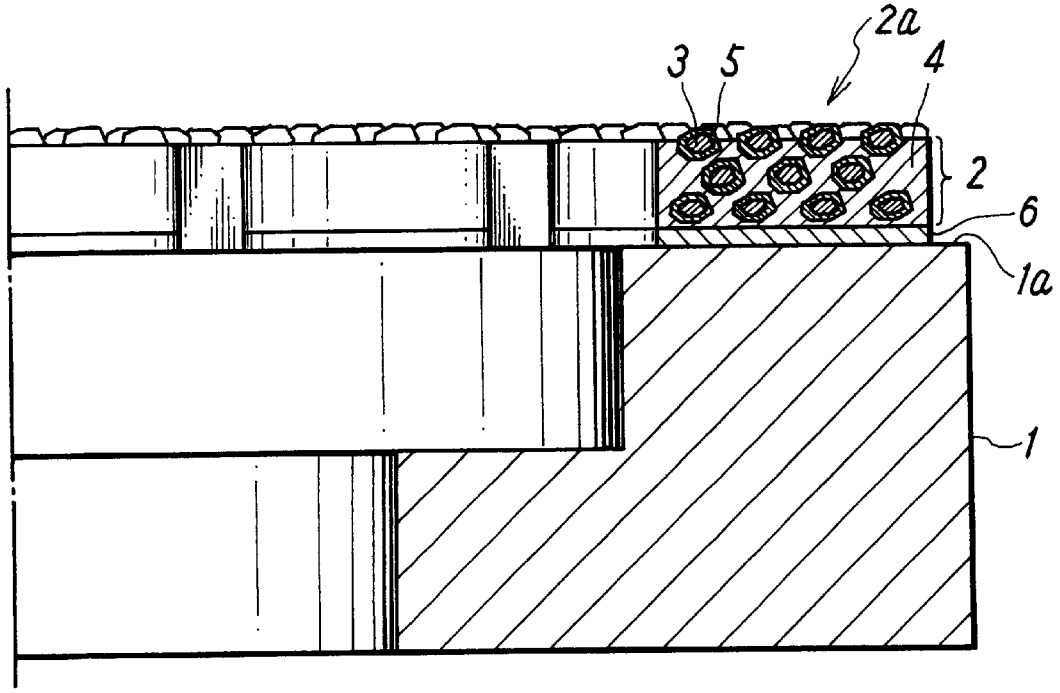
FIG. 2 is a cross-sectional view showing the main part of the dresser that is cut at the flat face in parallel to the rotating center of the dresser.

Referring to the drawings, FIG. 1 and FIG. 2 show the embodiments of the dresser for a CMP polishing cloth according to the present invention. FIG. 1 shows the overall constitution. FIG. 2 shows a cross-section of the dresser that is sectioned at the face through a central axis of rotation.

In the dresser for a CMP polishing cloth according to the example, many of the above sintered products are adhered to the working face of the cup-shaped pedestal made of metal, ceramic, or plastic. As shown in FIG. 2, the diamond grit 3 in the sintered product has the carbide film 5 generated on the surface thereof. The diamond grit 3 is bounded firmly with the bonding material 4 by the carbide film 5.

If the bonding material 4 comprising silicon and/or silicon alloy is mixed with the diamond grit 3, the mixture is formed and sintered, the carbide film 5 is generated on the surface of the diamond grit by sintering the silicon in the bonding material 4 into the diamond grit 3. Also, the carbide film 5 can be formed by coating the surface of the diamond grit 3 with the carbide film 5 of a metal from group IV, V, or VI in the periodic table.

Grain size of the diamond grit 3 is not limited. Generally, it is preferable that the grit having a grain size of #325/#400 to #30/#40 according to JIS B4130 be used. If the grain size of the diamond grit is less than #325/400, exposure amount at the dressing face of the diamond grit is lower, and this cause imperfect dressing of a CMP polishing cloth or slower dressing speed. If the grain size of the diamond grit exceeds #30/#40, it might cause a rough face of the CMP polishing cloth when dressing or cause a lower rate of removal.

If silicon alloy is used as at least a part of the bonding member 4, preferably it has a silicon content of 15 percent by weight. Metals in groups IV, V, or VI of the periodic table may be used as alloy metal. In particular, titanium, chrome, tantalum, tungsten, or molybdenum is preferably used. If the silicon content is less than 15 percent by weight, the obtained sintered product 2 might have poor acid-resistance.

As a sintering method employable in the present invention, there are many methods including hot-pressing using graphite, pressure sintering with current, hot isostatic pressing (HIP), or sintering with an ultrahigh pressure device. Sintering according to the present invention is not limited to certain sintering methods, but a preferable sintering method may be chosen and employed as required.

As a method of coating the carbide film 5 on the diamond grit 3, there is a PVD method, a CVD method, a plating method, or an immersion method using a melted salt bath. A preferable method may be chosen and employed as required.

If the sintered product 2 is used as a dresser, as shown in FIG. 1 and FIG. 2, the sintered product is fixed on the working face 1*a* around the pedestal 1 by an adhesive 6, then the dressing face 2*a* is planarized and is dressed. Thereby, the product is finished into a specified size and the diamond grit is exposed for dressing.

Since the dresser for a CMP polishing cloth constituted accordingly has a bonding material employing acid-resistant silicon or silicon alloy, metal never dissolves and the diamond grit is never peeled off. Therefore, wafer-cleaning steps after CMP processing can be simplified and scratches on a work surface caused by peeling-off of the diamond grit from the dressing face 2*a* can be prevented.

Hereinafter, a further description will be given in detail, with reference to preferred examples. However, the present invention will not be limited by these examples.

EXAMPLES

Example 1

Diamond grit having a grain size of #100/#200 is mixed with titanium-silicon alloy powder at 1:1 by weight so as to yield a mixture of volume ratio of 1:3. Then, an obtained mixed powder is filled in a graphite frame, and then it is sintered at a sintering temperature of 1,200 degrees Celsius and under a pressure of 50 Mpa for an hour by hot-pressing. After an obtained sintered product is adhered on a pedestal (refer to FIG. 1) made from a stainless steel (SUS 316) with an epoxy adhesive, the dressing face of the product is planarized and dressing-processed by using a GC grinding wheel having a grain size of #240 so that the thickness of the product and the height of protrusion of the diamond grit from the matrix may be 2 millimeters and 50 micrometers respectively. This forms a dresser.

The following acid-resistance test and durability test of grit-peeling-off were carried out on the dresser.

Figure 3:
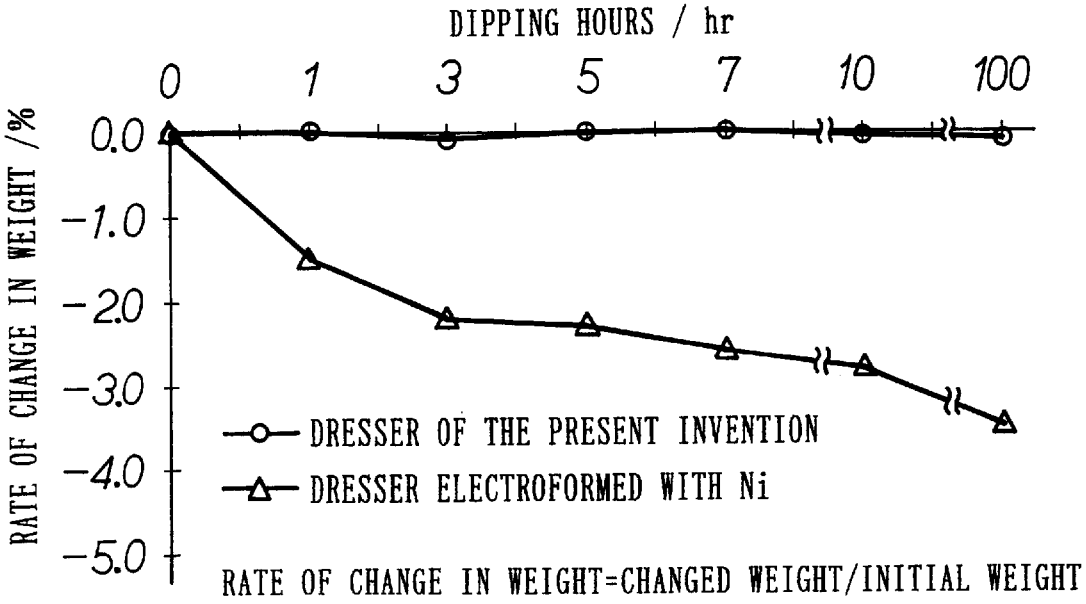
FIG. 3 is a graph showing the results of an acid resistance test on the dresser for a polishing cloth and a comparative sample.

In the acid-resistant test, a sliced sintered product is dipped in a nitric acid water solution for 1,000 hours, then the rate of change in weight of the product is measured with an electrobalance (measuring sensitivity 1 mg). FIG. 3 shows the rate of change in weight (vertical axis) to dipping hours (horizontal axis). The figure shows that there was no weight decrease and that the product had superior acid-resistance.

For comparison, a sample in which diamond grit with a grain size of #100/#120 electroformed with Ni was subjected to the same acid-resistance test. The result shows that the rate of change in weight after 30 hours was 4.0 percent.

Figure 4:
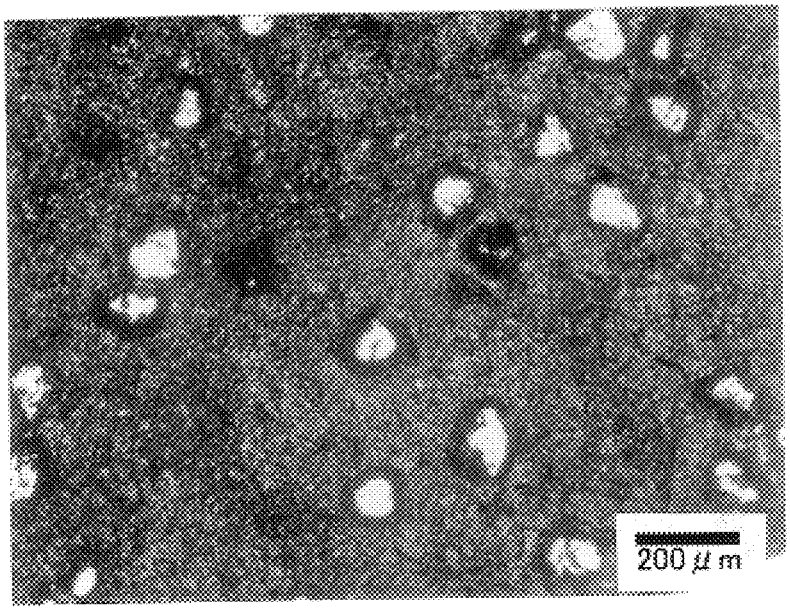
FIG. 4 is an optical microscope photograph, instead of a drawing, showing an observed surface in front of the dresser for a polishing cloth in Example 1 according to the present invention.
Figure 5:
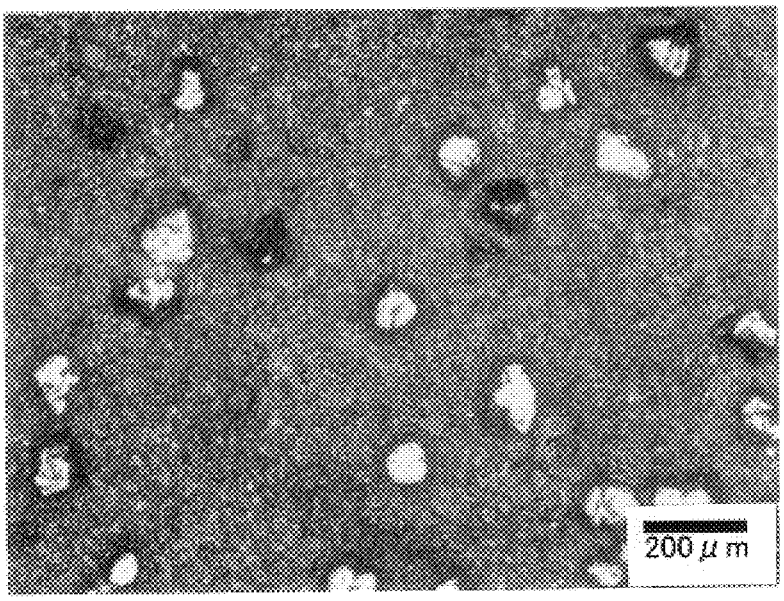
FIG. 5 is an optical microscope photograph, instead of a drawing, showing an observed rear side of the dresser for a polishing cloth at the same position as in FIG. 4 in Example 1 according to the present invention.

In the durability test of peeling-off, the dresser is pressed on the surface of a CMP polishing cloth made of urethane foam with a face pressure of 20 kPa, then the dresser was subjected to continuous dressing for 1,000 hours while slurry containing 2 weight percent of alumina abrasive grains having a grain size of #4000 is sprayed at 12 milliliters per minute. The surface of the dresser was observed with a optical microscope at four points to inspect peeling-off of the diamond grit and changes in height. FIGS. 4 and 5 respectively show the results of the observation before and after dressing. According to these figures (photographs), no peeling-off of the diamond is observed. Furthermore, no change in protrusion of the diamond grit is observed, and the product is confirmed to have durability and excellent grain retention.

Example 2

Diamond grit, coated with titanium carbide of about 2 micrometers by a CVD method, having a grain size of #100/#200 is mixed with titanium-silicon alloy powder at 1:1 by weight so as to make a mixture having a volume ratio of 1:3. Then, an obtained mixed powder is filled in a graphite frame, then it is sintered at a sintering temperature of 1,200 degrees Celsius and a pressure of 50 Mpa for an hour by hot-pressing. After an obtained sintered product is adhered to a pedestal made from stainless steel (SUS 316) with an epoxy adhesive, the dressing face of the product is planarized and dressing-processed by using a GC grinding wheel size of #240 so that the thickness of the product and the height of protrusion of the diamond grit from matrix may be 2 millimeters and 50 micrometers, respectively. This becomes a dresser. The following acid-resistance test is a durability test for grid-peeling-off carried out for the dresser under the same conditions as in Example 1.

Figure 6:
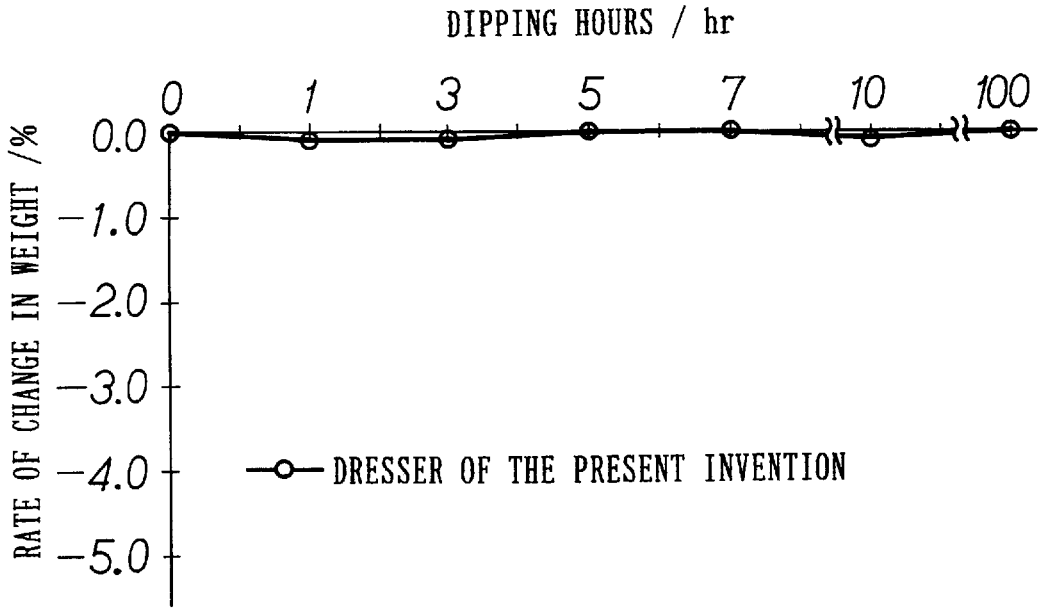
FIG. 6 is a graph showing the results of an acid resistance test of the dresser for a polishing cloth in Example 2 according to the present invention.

The result of the acid-resistance test is shown in FIG. 6. The figure shows that no increase in weight of the product is seen and the product has superior acid-resistance. Furthermore, similarly as in the first embodiment, peeling-off of the diamond grit and change in the height of protrusion are observed at four points on the dresser before and after dressing. Neither peeling-off of the diamond grit nor change in the height of the protrusion of the diamond grit is observed before and after dressing. The product is therefor confirmed to exhibit superior durability in holding grit.

By using the dresser for a CMP polishing cloth, when used for CMP processing under strongly acidic conditions, the diamond grit will not peel off, and stable dressing is carried out. Furthermore, according to the manufacturing method in the present invention, the dresser for a CMP polishing cloth can be obtained by a simple method.

What is claimed is:

1. A dresser for a polishing cloth, wherein a dressing face thereof comprises a sintered product obtained by mixing a bonding material comprising silicon or silicon alloy or both with diamond grit, and forming and sintering the mixture; and a carbide film generated by sintering the silicon in the bonding material into the diamond, which is provided on a surface of said diamond grit, whereby said diamond grit is bonded with the bonding material.

2. The dresser of claim 1, wherein said diamond grit has a grain size of #325/#400 to #30/#40 according to JIS B 4130.

3. A dresser for a polishing cloth, wherein the sintered product of claim 1 or adhered on the surface of a pedestal, the product is finished into a specified size by planarizing and dressing on the surface thereof, and the diamond grit is exposed.

4. A dresser for a polishing cloth, wherein a dressing face thereof comprises a sintered product obtained by mixing a bonding material comprising silicon or silicon alloy or both with diamond grit coated with a carbide film of a metal of group IV, V or VI of the periodic table; and forming and sintering the mixture whereby the diamond grit is bonded with the bonding material with said carbide film.

5. The dresser of claim 4, wherein said diamond grit has a grain size of #325/#400 to #301#40 according to JIS B 4130.

6. The dresser of claim 4, wherein said silicon alloy comprises a silicon content of at least 15% by weight.

7. The dresser of claim 4, wherein said metal of Group IV, V or VI of the periodic table is selected from the group consisting of titanium, chromium, tantalum, tungsten or molybdenum.

8. A method of manufacturing a dresser for a polishing cloth, which comprises generating a carbide film by sintering diamond grit into silicon in the bonding material on the surface of said diamond grit, mixing the bonding material comprising silicon or silicon alloy or both with diamond grit, and forming and sintering the mixture, and the sintering product for dressing, whereby said diamond grit is bonded with the bonding material by the carbide film.

9. A method of manufacturing a dresser for a polishing cloth, which comprises mixing silicon or silicon alloy or both with diamond grit coated with a carbide film of a metal of group IV, V, or VI of the periodic table, forming and sintering the mixture, thereby bonding the sintered product for dressing with the bonding material by the carbide film.

10. The method of claim 9, wherein said diamond grit has a grain size of #325/#400 to #30/#40 according to JIS B 4130.

11. The method of claim 9, wherein said metal of group IV, V or VI of the periodic table is selected from the group consisting of titanium, chromium, tantalum, tungsten or molybdenum.

* * * * *